US006933893B2

(12) United States Patent
Rubinshteyn et al.

(10) Patent No.: US 6,933,893 B2
(45) Date of Patent: Aug. 23, 2005

(54) ELECTRONICALLY TUNABLE PLANAR ANTENNA AND METHOD OF TUNING THE SAME

(75) Inventors: Boris Rubinshteyn, Palatine, IL (US); Roger L Scheer, Crystal Lake, IL (US)

(73) Assignee: Motorola, Inc., Schaumburg, IL (US)

( * ) Notice: Subject to any disclaimer, the term of this patent is extended or adjusted under 35 U.S.C. 154(b) by 12 days.

(21) Appl. No.: 10/330,155

(22) Filed: Dec. 27, 2002

(65) Prior Publication Data

US 2004/0125027 A1 Jul. 1, 2004

(51) Int. Cl.[7] ..... H01Q 1/38; H01Q 1/24
(52) U.S. Cl. ..... 343/700 MS; 343/702
(58) Field of Search ..... 343/700 MS, 702

(56) References Cited

U.S. PATENT DOCUMENTS

| | | | | |
|---|---|---|---|---|
| 5,969,681 | A * | 10/1999 | O'Neill, Jr. | 343/700 MS |
| 6,140,966 | A * | 10/2000 | Pankinaho | 343/700 MS |
| 6,175,334 | B1 * | 1/2001 | Vannatta et al. | 343/702 |
| 6,268,831 | B1 | 7/2001 | Sanford | 343/700 |
| 6,509,881 | B2 * | 1/2003 | Falk | 343/771 |
| 6,650,295 | B2 * | 11/2003 | Ollikainen et al. | 343/700 MS |
| 2002/0044091 | A1 | 4/2002 | Mikkola et al. | 343/700 |

OTHER PUBLICATIONS

Liu, Hall and Wake; "Dual–Frequency Planar Inverted–F Antenna"; IEEE Transactions on Antennas and Propagation, vol. 45, No. 10, Oct. 1997; pp. 1451–1458.

Song, Hall, Ghafouri–Shiraz and Wake; "Triple–Band Planar Inverted F Antenna"; 1999 IEEE; pp. 908–911.

Yajun and Kwang; "One Novel Single–Patch Dual–Frequency Planar Inverted–F Antenna"; 2000 IEEE 2nd Int'l Conf on Microwave and Millimeter Wave Tech Proceedings; pp. 444–447.

* cited by examiner

*Primary Examiner*—James Vannucci
(74) *Attorney, Agent, or Firm*—Charles W. Bethards

(57) ABSTRACT

An electronically tunable planar antenna 12, a wireless communication device 10, and a method of tuning an antenna 12 in which a high band element 28 and a low band element 26 each have a resonant center frequency. At any given time, the antenna 12 has two center resonant frequencies and thus allows the device to operate at two frequencies simultaneously. In addition, tuning circuits 38, 36 are connected to the low band element 26 and the high band element 28, respectively. The tuning circuits 36, 38 electronically change the resonant center frequency of the corresponding element 26, 28. Accordingly, in the device 10 the method, and the antenna one or both of the center frequencies can be changed to permit operation at more than two frequencies.

20 Claims, 7 Drawing Sheets

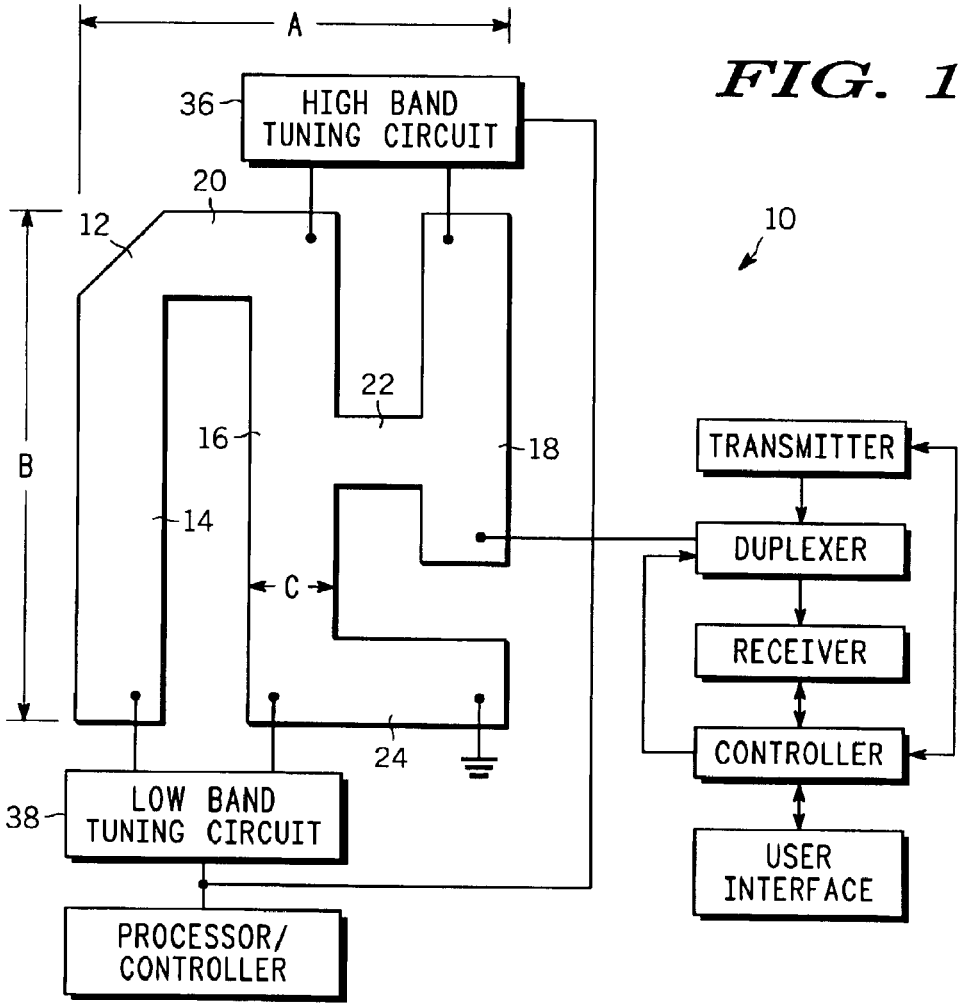
FIG. 1
FIG. 2
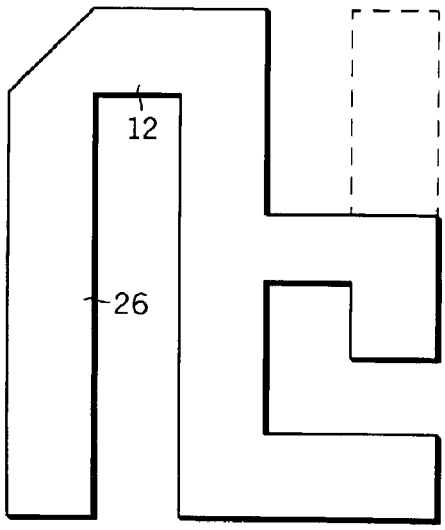
FIG. 3
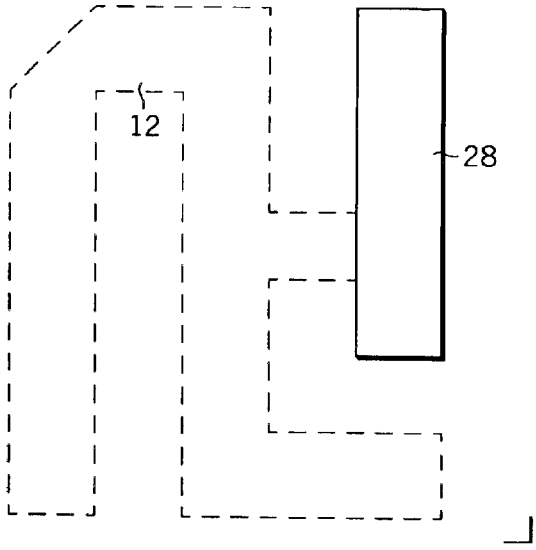

| FREQUENCY | SWITCH 1 | SWITCH 2 | SWITCH 3 |
|---|---|---|---|
| 1 | OFF | OFF | OFF |
| 2 | ON | OFF | OFF |
| 3 | OFF | ON | OFF |
| 4 | OFF | OFF | ON |
| 5 | ON | ON | OFF |
| 6 | ON | OFF | ON |
| 7 | OFF | ON | ON |
| 8 | ON | ON | ON |

*FIG. 5*

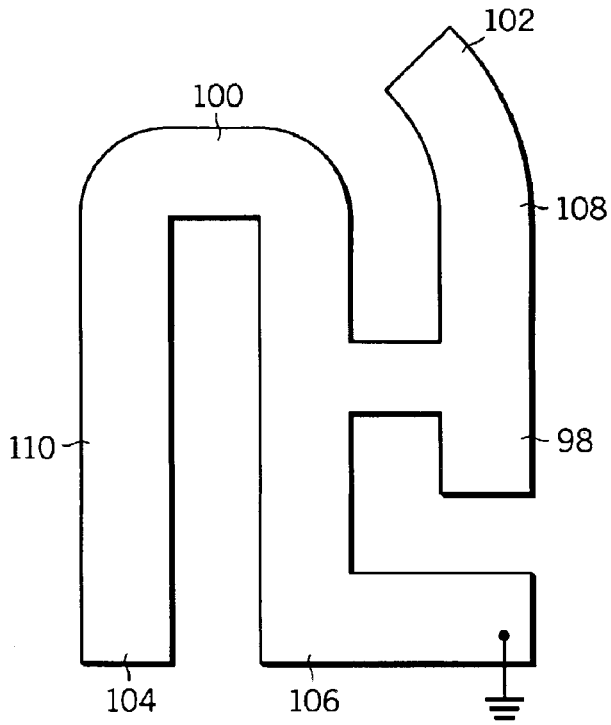
FIG. 9
90
FIG. 10
92
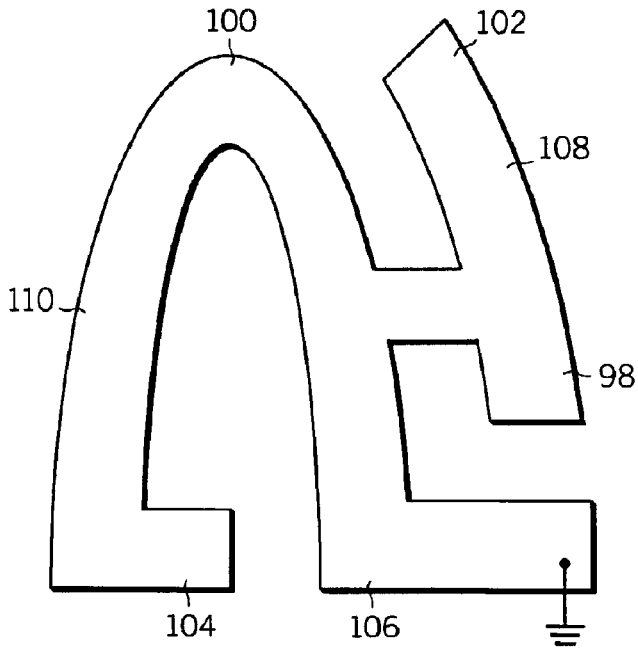

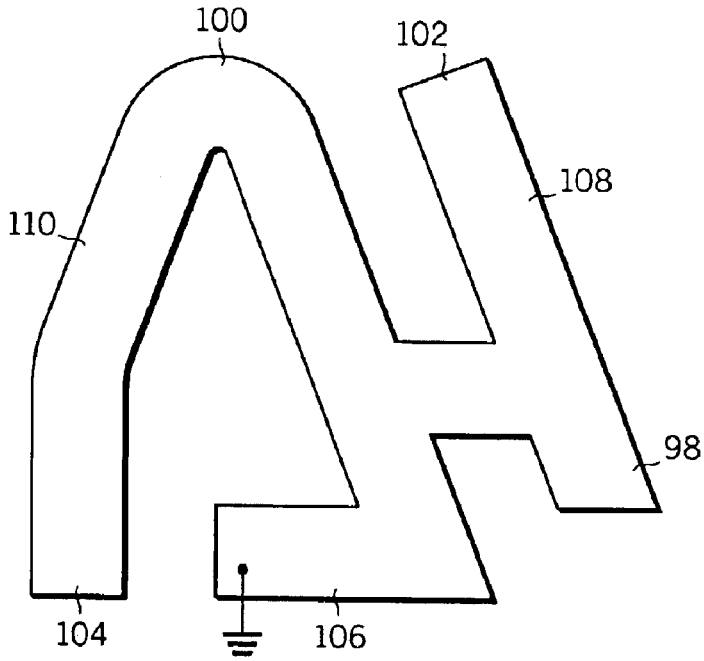
FIG. 11
94
FIG. 12
96
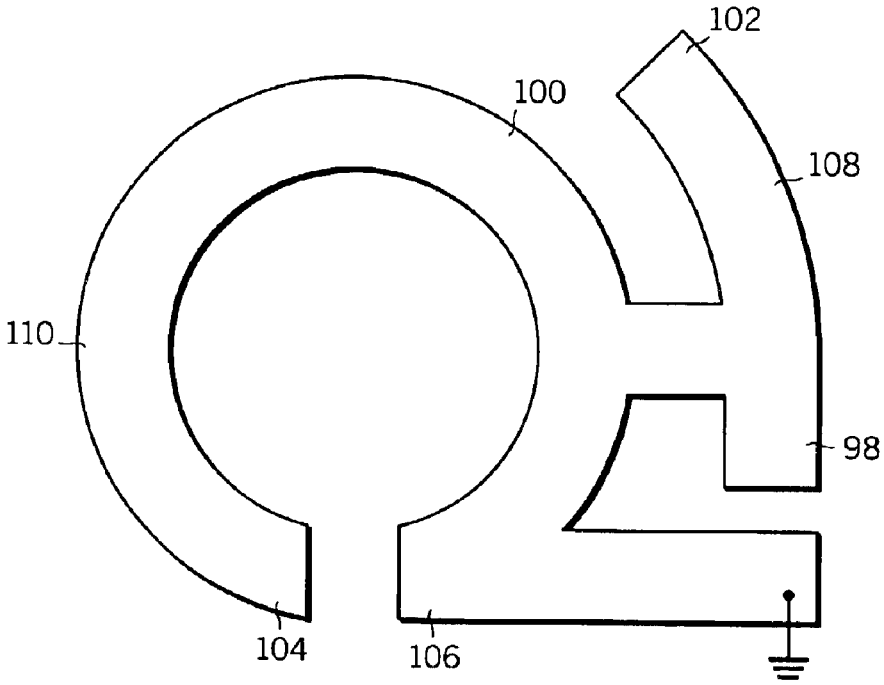

ELECTRONICALLY TUNABLE PLANAR ANTENNA AND METHOD OF TUNING THE SAME

FIELD OF THE INVENTION

This invention relates in general to wireless communication devices, and more specifically to tunable, multiple-frequency planar antennas for wireless communication devices.

BACKGROUND OF THE INVENTION

Wireless communication devices generally refer to communications terminals that provide a wireless communications link to one or more other communications terminals. Wireless communication devices may be used in a variety of different applications, including cellular telephone, land-mobile (e.g., police and fire departments), and satellite communications systems. Wireless communication devices typically include an antenna for transmitting and/or receiving wireless communications signals. In the current wireless communication environment, wireless communication devices such as cellular handsets require the ability to simultaneously use multiple frequency bands, for example, to access different services. In addition, users of such devices, such as international travelers, may need to use the devices in regions where the local communications frequencies differ, so there is a need for a device that can accommodate different transmission frequencies. There is also a strong demand to further miniaturize such devices and to make the antenna invisible. As a result, there is increasing need for a small, internal antenna that is resonant at multiple frequencies and that can be tuned to different frequencies.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and to explain various principles and advantages all in accordance with the present invention.

FIG. 1 is a plan view and block diagram of a tunable planar antenna and of elements connected to the antenna in a preferred embodiment of the invention;

FIG. 2 is a diagrammatic plan view of the antenna of FIG. 1 in which a low band part of the antenna is indicated by solid lines;

FIG. 3 is a diagrammatic plan view of the antenna of FIG. 1 in which a high band part of the antenna is indicated by solid lines;

FIG. 5 is a table showing the states of the switches of FIG. 4 for eight different antenna frequencies;

FIG. 9 is a plan view of a two dimensional antenna of another embodiment;

FIG. 10 is a plan view of a two dimensional antenna of another embodiment;

FIG. 11 is a plan view of a two dimensional antenna of a further embodiment; and FIG. 12 is a plan view of a two dimensional antenna of a further embodiment.

DETAILED DESCRIPTION OF PREFERRED EMBODIMENTS

Figure 4:
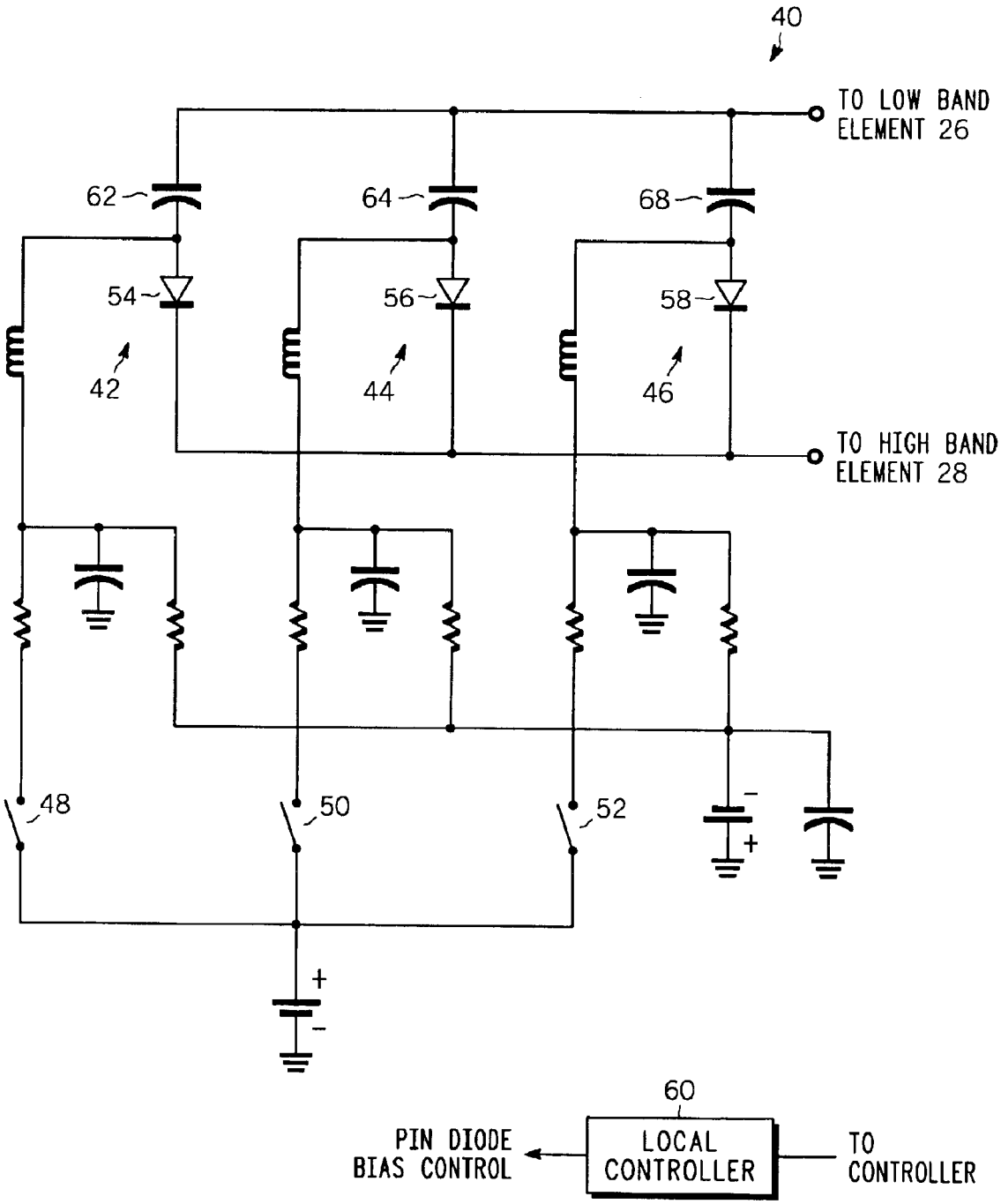
FIG. 4 is a schematic diagram of one example of a tuning circuit for the antenna of FIG. 1.

In overview, the present disclosure concerns a wireless communication device that has a planar, tunable antenna. In particular, the antenna is designed such that it resonates at two different center frequencies simultaneously, which permits simultaneous operation of the device at two different frequencies. That is, reception or transmission of RF signals may be performed at two different frequencies simultaneously. Further, tuning circuits can change one or both of the two center frequencies at which the antenna resonates. Therefore, the device can operate at multiple frequencies. This allows, for example, international travelers to use cellular handsets in various regions having differing transmission standards. Further, it allows a user in one region to use multiple services with the same antenna. For example, the same antenna that is used for voice communication might also be used for receiving global positioning, or GPS, signals. In addition, the antenna is relatively small and can be easily hidden within the housing of a portable handset.

The wireless device, the antenna, and the method of tuning the antenna of the wireless device discussed below are intended to and will alleviate problems caused by prior art wireless devices. It is expected that one of ordinary skill, given the described principles, concepts and examples will be able to implement other similar procedures and configurations. It is anticipated that the claims below cover such other examples.

The following is a description of the embodiment shown in FIG. 1. A wireless device 10 includes a two-dimensional inverted-F antenna 12, which is sometimes referred to as a planar inverted-F antenna, or PIFA. The word "planar" does not mean that the antenna must lie in a plane while in use. The antenna 12 may be curved to conform to the body of a handset housing, for example. The antenna is also sometimes referred to as a folded inverted-F antenna, since the leftmost element is thought of as being folded to reduce the length of the antenna.

The antenna 12 is made of conductive material such as metal. The antenna 12 may be etched from a thin copper layer formed on a printed circuit board, for example, and tuning circuitry for tuning the antenna 12 may or may not be included on the same circuit board. The antenna may be applied to the inside of a handset or other wireless device such that it is out of sight to users. The antenna 12 is generally formed by two dimensional, elements that are joined together. The antenna 12 has a first longitudinal element 14, a second longitudinal element 16, and a third longitudinal element 18, as shown. The first longitudinal element 14 is spaced apart from the second longitudinal element 16, and the third longitudinal element 18 is spaced apart from the second longitudinal element 16. Connected to the longitudinal elements are a first lateral element 20, a second lateral element 22, and a third lateral element 24, which are spaced apart from one another, as shown.

With reference to FIG. 1, the end of the antenna at which a high band tuning circuit 36 is connected is referred to as the upper end of the antenna for discussion purposes only and is not necessarily located in an upward position in an actual device.

At the upper end of the antenna, the first lateral element 20 joins the first longitudinal element 14 to the second longitudinal element 16. Midway along the second longitudinal element 16, the second lateral element 22 joins the second longitudinal element 16 to the third longitudinal element 18. The third lateral element 24 extends from the lower end of the second longitudinal element 16 as shown. Although the elements are shown to be orthogonal or parallel in FIG. 1, the elements need not be strictly orthogonal or parallel for the device to work, which is apparent from the alternative embodiments of FIGS. 9-12.

The elements of the antenna 12 form a low band element 26 directly coupled to a high band element 28, as shown in FIGS. 2 and 3. The low band element 26 is simultaneously resonant at a lower frequency than the high band element 28. Thus, the antenna 12 is resonant at two different center frequencies, which allows operation in two bands simultaneously. The low band element 26 and the high band element 28 share a common RF input point, which is located at the lower end of the third longitudinal element 18 and which is connected to a duplexer, as shown in FIG. 1. The duplexer is connected to a transmitter and a receiver. Both the transmitter and the receiver are connected to a controller, and the controller is connected to a user interface. The wireless device 10 includes other elements, such as a microphone and a speaker, which are not illustrated for the sake of simplicity.

The antenna 12 of this embodiment has the high and low band elements 26, 28 and thus has two resonant center frequencies and thus permits operation of the device 10 at two frequencies simultaneously. Conceivably, however, the antenna of the device 10 may have more than two elements and may have more than two simultaneous resonant frequencies.

The corner formed by the first longitudinal element 14 and the first lateral element 20 is beveled to reduce power losses in RF signal propagation. Other corners may be similarly beveled or otherwise shaped to reduce power losses.

The letters A, B and C in FIG. 1 represent the dimensions of the antenna 12. The dimensions must be determined according to the specifications for each application, however, the following dimensions were used in a successful prototype: A=25 mm, B=45 mm, and C=5 mm. The lateral spacing between the longitudinal elements 14, 16, 18 is approximately 5 mm, which is not considered to be a critical dimension but is preferred.

The low band element 26 is connected to a low band tuning circuit 38. That is, one terminal of the low band tuning circuit 38 is connected to a predetermined point on the lower end of the first longitudinal element 14 of the low band element 26, and another terminal of the low band tuning circuit 38 is connected to a predetermined point on the lower end of the second longitudinal element 16, which is also part of the low band element 26.

The high band tuning circuit 38 is connected to both the high band element 28 and the low band element 26. That is, one terminal of the high band tuning circuit 38 is connected to a predetermined point on the upper end of the second longitudinal element 16, which is part of the low band element 26, and another terminal of the high band tuning circuit 38 is connected to a predetermined point on the third longitudinal element 18, which is part of the high band element 28.

The high band tuning circuit 36 and the low band tuning circuit 38 electronically alter the frequencies at which the elements 26, 28 resonate. This can be accomplished in many ways, one of which is to selectively couple a reactance or multiple stages of reactance between elements of the antenna, as disclosed more specifically in the second and third embodiments. The reactance is preferable a capacitive reactance, but may be a combination of a capacitive reactance and an inductive reactance. A processor or controller can be connected to the high and low band tuning circuits 36, 38 to independently control the high and low band tuning circuits to tune the antenna 12 to multiple pairs of high band and low band frequencies. Therefore, at any given time, the antenna is resonant at two frequencies, but those two frequencies may each be changed by the respective tuning circuits 36, 38 and the associated controller to provide numerous different frequency pairs at which the antenna is resonant.

FIG. 4 shows a high band tuning circuit 40 of a second embodiment of the wireless communication device. The high band tuning circuit 40 is one example of a circuit that can be employed as the high band tuning circuit 36 in FIG. 1. The low band tuning circuit 38 may be essentially the same as the high band tuning circuit.

The high band tuning circuit 40 includes three capacitors 62, 64, 68, which are connected in a parallel manner between two predetermined points on the antenna 12. In series with each capacitor 62, 64, 68 is a PIN diode 54, 56, 58. Each PIN diode 54, 56, 58 is forwardly biased by the closure of a corresponding switch 48, 50, 52. In practice, transistors would most likely form the switches 48, 50, 52. Other elements of the circuit 40 serve to reverse bias each PIN diodes 54, 56, 58 when the corresponding switch 48, 50, 52 is open in a manner well understood by those skilled in the art.

When one of the switches 48, 50, 52 is closed, the corresponding PIN diode 54, 56, 58 is in a conducting state (forward biased) and thus couples the corresponding capacitor 62, 64, 68 between the predetermined points of the antenna. Each capacitor 62, 64, 68 effectively alters the electrical length of the high band element, in this case, thus changing the center frequency at which the high band element is resonant. Alternatively, although not illustrated, each of the capacitors 62, 64, 68 may be connected in parallel or in series with an inductor. Thus, the tuning circuit couples a reactance, which may be capacitive or a combination of a capacitive and inductive reactance, to the antenna to alter the center resonant frequency.

Although PIN diodes are employed as a switching device in the embodiment of FIG. 4, switching devices other than PIN diodes may be employed. A high Q resonant switching circuit is desired in order to provide good tuning selectivity and low loss. The ideal switching device for this purpose would have very low ON resistance, very high isolation properties in the OFF state, and would be completely linear throughout the desired frequency range. Several RF switching devices could be adapted for use in the tuning circuit. Examples of such devices are: MicroElectroMechanical Systems (MEMS), voltage variable capacitors (VVCs), and pseudomorphic high electron mobility transistors (PHEMTs). PIN diodes are preferred because of their availability and widespread use, their relative linearity, moderately low ON resistance, and moderately high OFF state isolation.

When one of the switches 48, 50, 52 is open, the corresponding PIN diode 54, 56, 58 is reversed biased and rendered non-conducting. This removes the capacitance of the associated capacitor 62, 64, 68 and substantially forms an open circuit at the reverse biased PIN diode 54, 56, 58.

A local controller 60 independently controls the switches 48, 50, 52. The local controller 60 is connected another controller such as a main controller. The local controller 60 is, for example, a digital signal processor, or DSP. Input signals from the main controller indicate to the local controller 60 which of the switches 48, 50, 52 should be open and which should be closed, and the local controller 60 produces the required output to actuate the switches accordingly. Therefore, any combination of the states of the switches 48, 50, 52 can be produced.

In the embodiment of FIG. 4, the capacitance of the first capacitor is less than that of the second capacitor 64, and the capacitance of the second capacitor 64 is less than that of the third capacitor 68. Accordingly, the table of FIG. 5 shows that eight different resonant center frequencies of the high band element can be provided by different combinations of the states of the switches 48, 50, 52. Adding capacitance to the tuning circuit 40, that is, adding capacitance between the predetermined points of the antenna 12, lowers the resonant center frequency of the associated element 28. Therefore, frequency 2 in the table is lower than frequency 1, and frequency 3 is lower than frequency 2. Choosing the capacitance of the capacitors depends upon the antenna being used and the specifications of the desired application and thus must be determined experimentally.

Since a tuning circuit identical to that of FIG. 4 can also be employed as the low band tuning circuit 38 of FIG. 1, many different frequency combinations can be produced, allowing the wireless communication device 10 to operate at many different pairs of frequencies. Changing the center resonant frequency of one of the band elements 26, 28 can be accomplished by sending a signal to the local controller 60, so frequency changes are rapid. The high band tuning circuit and the low band tuning circuit are controlled independently in the embodiment of FIG. 4. Thus, the resonant frequency of the high band element 28 can be changed without changing the resonant frequency of the low band element 26 if desired. In a manner well understood by those of ordinary skill in the art, a single local controller 60 can control the capacitance stages of both the high band tuning circuit and the low band tuning circuit.

Figure 6:
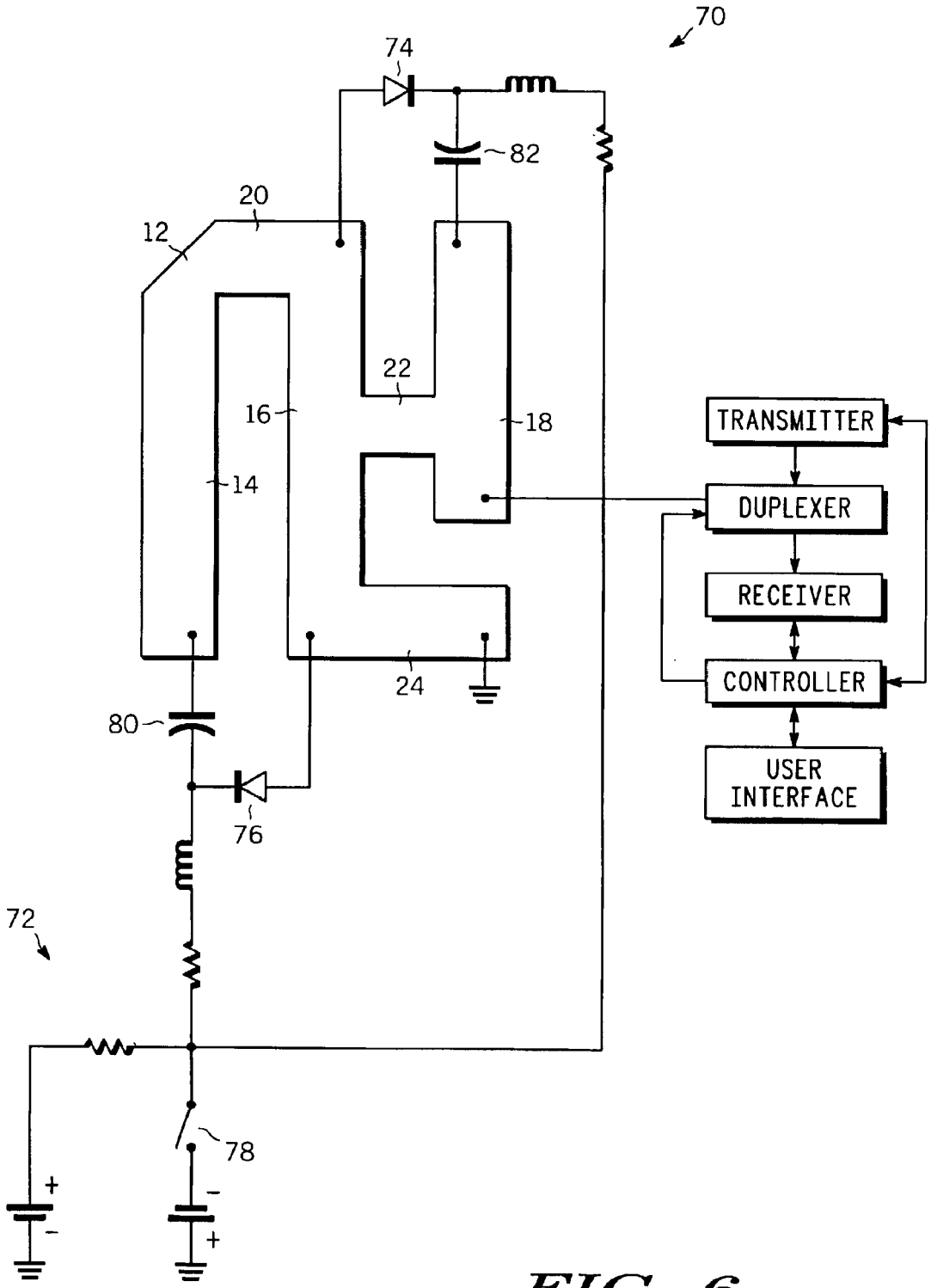
FIG. 6 is a plan view and schematic diagram of a tunable planar antenna and of elements connected to the antenna in a second preferred embodiment of the invention.

FIG. 6 shows a wireless communication device 70 of a third embodiment. The device 70 is quad-banded. That is, it operates in two bands simultaneously, that is, it has two resonant center frequencies. By changing the state of a switch 78, the two center frequencies are both changed, which allows the device 70 to operate in two different frequency bands. A controller or processor can change the state of the switch 78. Thus, in this embodiment, the high band element 28 and the low band element 26 are tuned in unison, not independently.

The device 70 includes a high band tuning circuit, which is connected to the second longitudinal element 16 and the third longitudinal element 18, as shown. A low band tuning circuit is connected to the second longitudinal element 16 and the first longitudinal element 14. In a manner similar to that described above, a capacitor 74 is connected between two predetermined points on the antenna 12 in the high band tuning circuit. Likewise, a capacitor 80 is connected between two predetermined points on the antenna 12 in the low band tuning circuit. Each capacitor 82, 80 has a corresponding PIN diode 74, 76 in series.

When the switch 78 is closed, the PIN diodes 74, 76 are in a conducting state and couple the capacitors 80, 82 between the respective pairs of predetermined points on the antenna 12. This alters the center resonant frequencies of both the high band element 28 and the low band element 26 simultaneously, which allows the device 70 to operate at a different pair of frequencies. When the switch 78 is open, the PIN diodes 74, 76 are in a non-conducting state and remove the capacitances of the capacitors 80, 82 between the respective pairs of predetermined points on the antenna 12. In other words, opening the switch 78 is an attempt to create an open circuit at the PIN diodes 74, 76.

Figure 7:
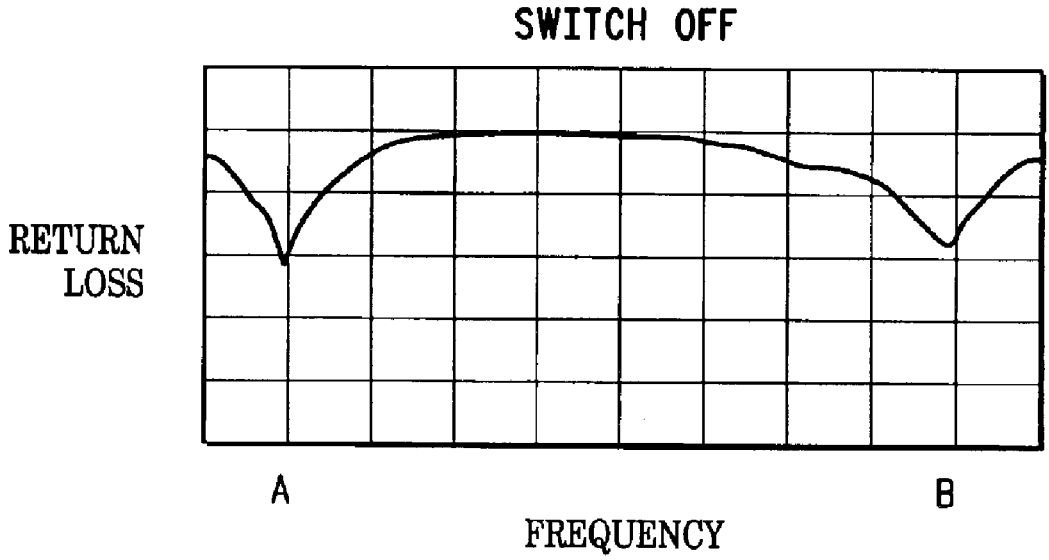
FIG. 7 is a graph of frequency versus return loss for the embodiment of FIG. 5 in a state when the switch is open.

FIG. 7 is a return loss graph for the antenna 12 of the device 70 of FIG. 6 when the switch 78 is open, or off. The vertical axis has a logarithmic scale. The plot shows two center frequencies A, B, at which the antenna resonates. Frequency A, the low band frequency, is approximately 915 MHz, which is a frequency used for wireless communication in Europe, and frequency B, the high band frequency, is approximately 1.9 GHz, which is a frequency used for wireless communication in the U.S.

Figure 8:
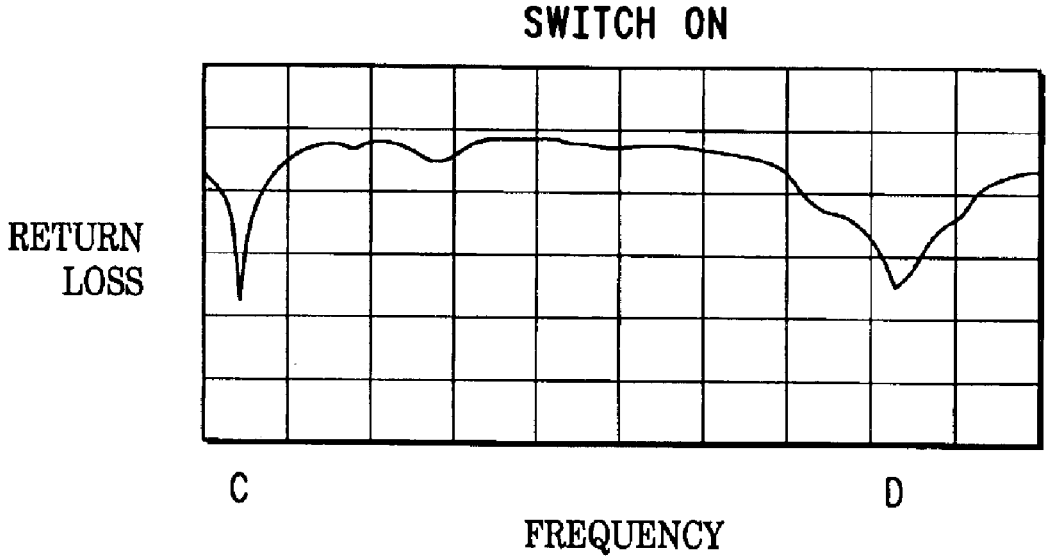
FIG. 8 is a graph of frequency versus return loss for the embodiment of FIG. 5 in a state when the switch is closed.

FIG. 8 shows a similar return loss plot taken with the switch 78 in the on, or closed, state in the device of FIG. 6. Again, the vertical axis has a logarithmic scale. In FIG. 8, two center frequencies C, D appear. Frequency C, the low band frequency, is approximately 840 MHz, which is a frequency used for wireless communication in the U.S., and frequency D, the high band frequency, is approximately 1.8 GHz, which is a frequency used for wireless communication in Europe.

FIGS. 9–12 show various configurations of the antenna. Each of the antennas of FIGS. 9–12 has a low band element 110, a high band element 108, a first high band predetermined point 100, at which one terminal of the high band tuning circuit 36 is connected, a second high band predetermined point 102, at which the other terminal of the high band tuning circuit 36 is connected, a first low band predetermined point 104, at which one terminal of the low band tuning circuit 36 is connected, a second low band predetermined point 106, at which the other terminal of the low band tuning circuit 36 is connected, and an RF input point 98, which is connected to the duplexer or similar component of the wireless communication device. FIGS. 9–12 illustrate that many variations in shape of the antenna 12 are possible.

This disclosure is intended to explain how to fashion and use various embodiments in accordance with the invention rather than to limit the true, intended, and fair scope and spirit thereof. The foregoing description is not intended to be exhaustive or to limit the invention to the precise form disclosed. Modifications or variations are possible in light of the above teachings. The embodiments were chosen and described to provide the best illustration of the principles of the invention and its practical application, and to enable one of ordinary skill in the art to utilize the invention in various embodiments and with various modifications as are suited to the particular use contemplated. All such modifications and variations are within the scope of the invention as determined by the appended claims, as may be amended during the pendency of this application for patent, and all equivalents thereof, when interpreted in accordance with the breadth to which they are fairly, legally, and equitably entitled.

What is claimed is:

1. A wireless communication device comprising:

an antenna that includes at least a high band element and a low band element, wherein the high band element is resonant at a first center frequency and the low band element is resonant at a second center frequency, wherein the second center frequency is different from the first center frequency and the wireless device can operate at two different frequencies simultaneously; and a tuning circuit connected to the antenna for changing at least one of the center frequencies at which the elements are resonant, such that the device operates at more than two frequencies using the antenna, wherein the tuning circuit is coupled between the high band element and the low band element.

2. The wireless communication device of claim 1, wherein the tuning circuit is a high band tuning circuit for tuning the high band element, and the device includes a low band tuning circuit connected to the low band element for tuning the low band element.

3. The wireless communication device of claim 1, wherein the tuning circuit includes a capacitor, and the tuning circuit selectively couples the capacitor between predetermined points on the antenna.

4. The wireless communication device of claim 3, wherein the tuning circuit includes a switching device connected to the capacitor, and the switching device is selectively changed between a conducting state and a substantially non-conducting state, wherein the capacitor is coupled between the predetermined points when the switching device is in the conducting state.

5. The wireless communication device of claim 4, wherein the switching device is a diode.

6. The wireless communication device of claim 3, wherein the capacitor is one of a plurality of capacitors in the tuning circuit, and each capacitor is connected between the predetermined points of the antenna, and the tuning circuit includes a plurality of switching devices in correspondence with the capacitors such that one switching device is connected to each capacitor, wherein each switching device is selectively changed between a conducting state and a substantially non-conducting state, and each capacitor is coupled between the predetermined points when the corresponding switching device is in a conducting state.

7. The wireless communication device of claim 6, wherein the tuning circuit includes:

a plurality of switches in correspondence with the switching devices such that each switching device is selectively actuated by the corresponding switch; and a local controller for selectively actuating the switches according to an input signal.

8. The wireless communication device of claim 1, wherein the antenna is two-dimensional and includes:

a first longitudinal element;

a second longitudinal element, which is spaced from and connected to the first longitudinal element; and a third longitudinal element, which is spaced from and connected to the second longitudinal element.

9. The wireless communication device of claim 8, wherein the low band element includes the first longitudinal element and the second longitudinal element, and the high band element includes the third longitudinal element.

10. The wireless communication device of claim 8, wherein the tuning circuit has two terminals, and one terminal of the tuning circuit is connected to the second longitudinal element, and the other terminal of the tuning circuit is connected to the third longitudinal element.

11. The wireless communication device of claim 8, wherein the tuning circuit has two terminals, and one terminal of the tuning circuit is connected to the first longitudinal element, and the other terminal of the tuning circuit is connected to the second longitudinal element.

12. The wireless communication device of claim 8, wherein the tuning circuit is a high band tuning circuit for tuning the high band element, and the device includes a low band tuning circuit connected to the low band element for tuning the low band element, and each tuning circuit has two antenna terminals, and wherein one antenna terminal of the high band tuning circuit is connected to the second longitudinal element, and the other antenna terminal of the high band tuning circuit is connected to the third longitudinal element, and one antenna terminal of the low band tuning circuit is connected to the first longitudinal element, and the other antenna terminal of the low band tuning circuit is connected to the second longitudinal element.

13. An antenna comprising:

a first longitudinal, two-dimensional element;

a second longitudinal, two-dimensional element, which is spaced from and connected to the first longitudinal element, wherein the first and second longitudinal elements are parts of a low band element that is resonant at a first center frequency and arranged as a folded inverted F antenna;

a third longitudinal, two-dimensional element, which is spaced from and connected to the second longitudinal element, wherein the third longitudinal element is included in a high band element that is directly coupled to the low band element, wherein the high band element is resonant at a second center frequency and arranged as a linear antenna, and the second center frequency is different from the first center frequency, and the antenna is resonant at the first center frequency and the second center frequency simultaneously; and a tuning circuit connected between predetermined points on the antenna to change the center frequency at which one of the elements resonates, such that the antenna operates at more than two frequencies.

14. The antenna of claim 13, wherein a two-dimensional transverse element extends between the second longitudinal element and the third longitudinal element.

15. The antenna of claim 14, wherein corresponding ends of the first and second longitudinal elements are joined to one another.

16. The antenna of claim 13, wherein a tuning circuit is connected between predetermined points on the antenna to change the center frequency at which one of the elements resonates, such that the antenna operates at more than two frequencies.

17. The antenna of claim 16, wherein the tuning circuit includes a plurality of parallel capacitors.

18. The antenna of claim 13, wherein the tuning circuit further comprising a capacitor and a switching device are connected in series between a predetermined point on the second longitudinal element and a predetermined point on the third longitudinal element, wherein the capacitor can be selectively coupled between the predetermined points according to the state of the switching device to electronically tune the high band element.

19. The antenna of claim 13, wherein the tuning circuit further comprising a capacitor and a switching device are connected in series between a predetermined point on the first longitudinal element and a predetermined point on the second longitudinal element, wherein the capacitor can be selectively coupled between the predetermined points according to the state of the switching device to electronically tune the low band element.

20. A method of operating a wireless communication device comprising:

receiving or transmitting signals at two different frequencies simultaneously with a single antenna, the single antenna comprising a first element and a second element; and electronically tuning the antenna by reactively coupling the first element to the second element with a tuning circuit coupled between points on the antenna such that at least one of the two frequencies is changed, such that the device can operate at more than two frequencies.

* * * * *

UNITED STATES PATENT AND TRADEMARK OFFICE

CERTIFICATE OF CORRECTION

PATENT NO. : 6,933,893 B2
APPLICATION NO. : 10/330155
DATED : August 23, 2005
INVENTOR(S) : Rubinshteyn et al.

It is certified that error appears in the above-identified patent and that said Letters Patent is hereby corrected as shown below:

Column 8 please delete "Claim 16. The antenna of claim 13, wherein a tuning circuit connected between predetermined points on the antenna to change the center frequency at which one of the elements resonates, such that the antenna operates at more that two frequencies." Please note this claim was canceled with the amendment filed on January 23, 2005.

Column 8 line 38 please delete "16" and insert --13--.

Signed and Sealed this

Ninth Day of January, 2007

JON W. DUDAS
*Director of the United States Patent and Trademark Office*